US010689150B2

(12) United States Patent
Rutstrom et al.

(10) Patent No.: US 10,689,150 B2
(45) Date of Patent: Jun. 23, 2020

(54) CONTAINER AND METHOD FOR STORAGE AND TRANSPORT OF SUPPORTED CONTENTS

(71) Applicant: Alliance Packaging, LLC, Renton, WA (US)

(72) Inventors: Lawrence L. Rutstrom, Kent, WA (US); George Jamison, Gig Harbor, WA (US)

(73) Assignee: Alliance Packaging, LLC, Renton, WA (US)

( * ) Notice: Subject to any disclaimer, the term of this patent is extended or adjusted under 35 U.S.C. 154(b) by 45 days.

(21) Appl. No.: 15/969,498

(22) Filed: May 2, 2018

(65) Prior Publication Data

US 2018/0319530 A1 Nov. 8, 2018

Related U.S. Application Data

(60) Provisional application No. 62/502,195, filed on May 5, 2017.

(51) Int. Cl.

| | |
|---|---|
| ***B65D 5/50*** | (2006.01) |
| ***B65D 85/50*** | (2006.01) |
| ***B65D 5/54*** | (2006.01) |
| ***B65D 5/02*** | (2006.01) |
| ***B65D 5/42*** | (2006.01) |

(52) U.S. Cl.

CPC ..... *B65D 5/5073* (2013.01); *B65D 5/0227* (2013.01); *B65D 5/4233* (2013.01); *B65D 5/541* (2013.01); *B65D 85/505* (2013.01)

(58) Field of Classification Search

CPC .. B65D 25/023; B65D 5/5028; B65D 5/5073; B65D 5/0227; B65D 5/4233; B65D 5/541; B65D 75/00; B65D 5/5035

USPC ..... 206/756, 784, 423; 229/120.18

See application file for complete search history.

(56) References Cited

U.S. PATENT DOCUMENTS

| | | | | | |
|---|---|---|---|---|---|
| 760,866 | A | | 5/1904 | Hohoff | |
| 880,549 | A | | 3/1908 | Lord | |
| 1,337,091 | A | | 4/1920 | Neski | |
| 1,493,152 | A | | 5/1924 | Gardner | |
| 1,606,523 | A | * | 11/1926 | Gardner | B65D 5/5002 47/84 |
| 1,669,617 | A | | 5/1928 | Kennedy | |
| 2,474,543 | A | * | 6/1949 | McLellan | B65D 5/5021 206/423 |

(Continued)

*Primary Examiner* — Chun Hoi Cheung
(74) *Attorney, Agent, or Firm* — Cozen O'Connor

(57) ABSTRACT

A container for transporting an item is provided having an outer case member erectable from a collapsed configuration to an erected configuration and at least one erectable support member fixedly attached to the outer case member. The support member may include: a first base panel; a second base panel foldably coupled to the first base panel to form a folded, dual-layer structure; a first functional portion foldably coupled to the first base panel and being foldable to form a structure to at least one of partially support or partially secure the item to be transported within the outer case member; and a second functional portion foldably coupled to the second base panel and being foldable to form another structure to at least one of partially support or partially secure the item to be transported within the outer case member. Methods of packaging and transporting an item in a container are also provided.

33 Claims, 8 Drawing Sheets

(56) References Cited

U.S. PATENT DOCUMENTS 2,682,949 A 7/1954 Whitehead
3,095,086 A 6/1963 Berg
3,229,889 A * 1/1966 Vrana ..... B65D 5/48004 229/120.14
3,352,053 A 11/1967 Anderson
3,552,059 A * 1/1971 Moore ..... B65D 77/02 47/41.12
3,752,035 A 8/1973 Cozzy et al.
3,829,003 A 8/1974 Dilot
3,973,356 A 8/1976 Schacht
4,105,154 A 8/1978 Meyers et al.
4,209,092 A 6/1980 Jones
4,213,559 A 7/1980 Meyers
4,335,842 A 6/1982 Bradford et al.
4,470,539 A 9/1984 Skillen
4,957,237 A 9/1990 Madonna et al.
5,044,548 A 9/1991 Olsen et al.
5,402,889 A 4/1995 Hermann et al.
5,803,267 A 9/1998 Tu et al.
5,938,109 A 8/1999 Sainz et al.
6,059,180 A * 5/2000 Collins ..... B65D 5/5016 206/591
6,463,697 B2 10/2002 Weder et al.
6,789,678 B2 * 9/2004 Auclair ..... B65D 5/5016 206/277
7,007,426 B1 * 3/2006 Ohlman, III ..... B65D 85/52 47/84
7,219,797 B2 * 5/2007 Kroeze ..... B65D 5/5016 206/423
D581,783 S 12/2008 Dixon
7,533,771 B2 5/2009 Allison
7,584,855 B2 9/2009 Rutstrom
7,980,454 B2 7/2011 Burton et al.
9,211,997 B2 12/2015 Rutstrom
9,598,229 B2 3/2017 Rutstrom
9,889,985 B2 2/2018 Rutstrom
2002/0179474 A1 * 12/2002 Levieux ..... A47G 7/025 206/423
2005/0045496 A1 * 3/2005 Jenkins ..... B65D 5/3621 206/45.25
2010/0147935 A1 * 6/2010 Younger ..... B65D 5/48036 229/120.18
2013/0119066 A1 * 5/2013 Hanna ..... B65D 5/6661 220/532
2013/0264363 A1 10/2013 Ballou et al.
2014/0217102 A1 * 8/2014 Wilson ..... B65D 5/48018 220/501
2014/0263353 A1 9/2014 Bell

* cited by examiner

CONTAINER AND METHOD FOR STORAGE AND TRANSPORT OF SUPPORTED CONTENTS

RELATED APPLICATIONS

This application claims priority to U.S. Provisional Application No. 62/502,195 entitled "CONTAINER AND METHOD FOR STORAGE AND TRANSPORT OF SUPPORTED CONTENTS," filed on May 5, 2017, the entire contents of which is hereby incorporated by reference.

BACKGROUND

Technical Field

This disclosure is generally related to containers, and more particularly, to containers and related methods for packaging fragile contents, such as, for example, flowers, for transport.

Description of the Related Art

In commercial and private settings, users have long benefited from containers, such as corrugated paperboard containers, when shipping goods, gifts, and other items. Furthermore, due to the increasingly interstate and global nature of relationships and businesses, individuals and businesses often communicate through remote gestures and distant dealings, such as shipping goods and/or gifts. Frequently, these items are fragile, as is the case when shipping flowers and breakables. Consequently, senders expend time, money and additional material to support and secure contents of the container for transport. Accordingly, existing containers include those designed to reduce assembly time and material while better securing the contents.

Some solutions include corrugated containers having a divider or support structure that provides some support of the contents. However, even when using these corrugated containers, the contents continue to experience some movement during transport. Consequently, other solutions include ties inserted through tie holes and engaging a portion of the contents as well as being tied to a portion of the container for further securing the contents in place. This tying process is time-consuming, cumbersome, and costly for individuals and businesses that ship many items, especially fragile items, such as flowers, on a regular basis. For such businesses, saving even a few seconds when assembling each container amounts to a sizeable time and cost savings over a longer duration, such as a day, a week or a month.

Additionally, ties such as strings, ribbons, or wires used to secure contents such as flowers also make opening conventional containers difficult. Particularly, when the contents are fragile, recipients of conventional containers often spend excess time and effort to untie the contents from the container to prevent damaging the contents. Furthermore, tying fragile and delicate contents such as flowers introduces additional opportunity for damaging the contents during transport.

Examples of corrugated containers for shipping fragile items such as flowers using wires or ties are disclosed in U.S. Pat. No. 7,219,797, which is incorporated herein by reference in its entirety. Examples of corrugated containers for shipping fragile items such as flowers in a tieless manner are disclosed in U.S. Pat. Nos. 7,584,855; 9,211,997; 9,598,229 and 9,889,985, each of which is incorporated herein by reference in its entirety.

BRIEF SUMMARY

Embodiments described herein provide container structures that are erectable in a particularly efficient manner and well adapted to transport fragile or delicate items, such as flowers. Embodiments may also be configured to support and transport items with reduced material demands relative to conventional containers for transporting similar items and/or with enhanced efficiency in erecting the container structures.

According to one embodiment, a container for transporting items, such as, for example, flowers, may be summarized as including: an outer case member having a plurality of sidewall panels and a plurality of base panels, the outer case member erectable from a collapsed configuration, in which the container is substantially flat, to an erected configuration, in which the plurality of sidewall panels and the plurality of base panels collectively define an interior cavity to receive the item to be transported; and a pair of support members, each support member being separate and distinct from the other and from the outer case member, and being fixedly coupled to a respective one of the plurality of the sidewall panels of the outer case member. Each support member may be at least partially erectable to project from a respective side of the outer case member to at least one of partially support or partially secure the item to be transported within the interior cavity of the outer case member. At least one of the support members may comprise: a first base panel; a second base panel foldably coupled to the first base panel and being fixedly attached to the first base panel in a face-to-face relationship to form a folded, dual-layer structure; a first functional portion foldably coupled to the first base panel and being foldable to form a structure to at least one of partially support or partially secure the item to be transported within the outer case member; and a second functional portion foldably coupled to the second base panel and being foldable to form another structure to at least one of partially support or partially secure the item to be transported within the outer case member.

The structure formed by the first functional portion may be a part of a trough to partially support the item to be transported within the interior cavity of the outer case member. The other structure formed by the second functional portion may include a cover movable between an open position and a closed position to conceal at least a portion of the item to be transported within the interior cavity of the outer case member when the cover is in the closed position. The other structure may also include a wedge device that cooperates with the first functional portion to secure the item to be transported within the outer case member.

In some instances, the first functional portion and the second function portion may be configured to sandwich a portion of the item or items between the first functional portion and the second function portion when the container is in a fully erected transport configuration. When the container is in a fully erected transport configuration, the first functional portion may contact the item to be transported from a first side and the second functional portion may contact the item to be transported from a second side opposite the first side. In some instances, the first functional portion and the second function portion may be configured to entrap the item to be transported within the interior cavity of the outer case member when the container is in a fully erected transport configuration.

The support members may be at least partially erectable to form adjacent trough structures for supporting the item to be transported, each trough structure including a support panel between opposing wing panels. The wing panels of the trough structure of each support member may be foldably coupled to and extend from the support panel and lock into a portion of the support member. The support members may include hold down members integrally formed with and extending from the support panels. The hold down members may be foldable about a plurality of preformed bend lines to collectively wrap around a portion of the item to be transported. The hold down members may include adhesive for securing the hold down members together in a state in which the hold down members collectively wrap around a portion of the item to be transported. The opposing wing panels of the trough structures may include apertures extending therethrough to receive one or more ties for securing the item to be transported to the trough structures. The trough structures may be configured to engage each other and lock the trough structures in an erected configuration.

In another embodiment, a container for transporting an item may be summarized as including: an outer case member erectable from a collapsed configuration to an erected configuration; and at least one support member fixedly attached to the outer case member. The support member may be at least partially erectable and may comprise: a first base panel; a second base panel foldably coupled to the first base panel and being fixedly attached to the first base panel in a face-to-face relationship to form a folded, dual-layer structure; a first functional portion foldably coupled to and extending from the first base panel and being manipulable to form a structure to at least one of partially support or partially secure the item to be transported within the outer case member; and a second functional portion foldably coupled to and extending from the second base panel and being manipulable to form another structure to at least one of partially support or partially secure the item to be transported within the outer case member.

The structure formed by the first functional portion may be a part of a trough to partially support the item to be transported within the outer case member. The other structure formed by the second functional portion may include a cover movable between an open position and a closed position to conceal at least a portion of the item to be transported in the outer case member when the cover is in the closed position. The other structure may also include a wedge device that cooperates with the first functional portion to secure the item to be transported in the outer case member. The first functional portion and the second function portion may be configured to sandwich a portion of the item between the first functional portion and the second function portion when the container is in a fully erected transport configuration. When the container is in a fully erected transport configuration, the first functional portion may contact the item to be transported from a first side and the second functional portion may contact the item to be transported from a second side opposite the first side. The first functional portion and the second function portion may be configured to entrap the item to be transported within the outer case member when the container is in a fully erected transport configuration.

The container may include a pair of support members that are at least partially erectable to form adjacent trough structures for supporting the item to be transported, each trough structure including a support panel between opposing wing panels. The wing panels of the trough structure of each support member may be foldably coupled to and extend from the support panel and lock into a portion of the support member. The support members may include hold down members integrally formed with and extending from the support panels. The hold down members may be foldable about a plurality of preformed bend lines to collectively wrap around a portion of the item to be transported. The hold down members may include adhesive for securing the hold down members together in a state in which the hold down members collectively wrap around a portion of the item to be transported. The opposing wing panels of the trough structures may include apertures extending therethrough to receive one or more ties for securing the item to be transported to the trough structures. The trough structures may be configured to engage each other and lock the trough structures in an erected configuration.

According to another embodiment, a method of packaging an item in a container for transport may be summarized as including: erecting an outer case member from a collapsed configuration to an erected configuration to define an interior cavity to receive the item; configuring a first functional portion of a support member that is fixedly attached to the outer case member to form a structure to at least one of partially support or partially secure the item to be transported within the outer case member; and configuring a second functional portion of the same support member that is fixedly attached to the outer case member to form another structure to at least one of partially support or partially secure the item to be transported within the outer case member.

The method may further include placing the item in the outer case member in the erected configuration to be supported at least in part by the first functional portion of the support member; and sandwiching the item between the first functional portion and the second functional portion of the support member.

The method may further include placing the item in the outer case member in the erected configuration to be supported at least in part by the first functional portion of the support member; and entrapping the item between the first functional portion and the second functional portion of the support member.

The support member may include a first base panel and a second base panel foldably coupled to the first base panel and fixedly attached to the first base panel in a face-to-face relationship to form a folded, dual-layer structure. The first functional portion may be foldably coupled to and extend from the first base panel, and the second functional portion may be foldably coupled to and extend from the second base panel.

Configuring the first functional portion may include configuring the first functional portion to form part of a trough to partially support the item to be transported within the outer case member. Configuring the second functional portion may include configuring the second functional portion to form a cover movable between an open position and a closed position to conceal at least a portion of the item to be transported in the outer case member when the cover is in the closed position. Configuring the second functional portion may also include configuring the second functional portion to form a wedge device that cooperates with the first functional portion to secure the item to be transported in the outer case member.

DETAILED DESCRIPTION

In the following description, certain specific details are set forth in order to provide a thorough understanding of various disclosed embodiments. However, one of ordinary skill in the relevant art will recognize that embodiments may be practiced without one or more of these specific details. In other instances, well-known structures associated with corrugated paperboard containers and methods of forming and erecting corrugated paperboard containers may not be shown or described in detail to avoid unnecessarily obscuring descriptions of the embodiments. For instance, it will be appreciated by those of ordinary skill in the relevant art that conventional folder-gluer machines or other conventional forming machines may be used to form the container structures described herein. In addition, it will be appreciated that the container structures described herein can be fabricated from materials that are formable and which can maintain a shape after being formed, such as, for example, corrugated paperboard. Still further, it will be appreciated that various panels of the container structures described herein may be separated by features configured to promote folding of the panels relative to each other. These features may include, for example, perforations, creases, score lines, cut lines, fold lines, combinations thereof or any other features to promote folding between the panels.

Unless the context requires otherwise, throughout the specification and claims which follow, the word "comprise" and variations thereof, such as "comprises" and "comprising," are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Embodiments described herein provide container structures that are erectable in a particularly efficient manner and well adapted to receive and transport items, including fragile or delicate items, such as flowers. Embodiments may also be configured to support and transport items with reduced material demands relative to conventional containers for transporting similar items and/or with enhanced efficiency in erecting the container structures.

Figure 1:
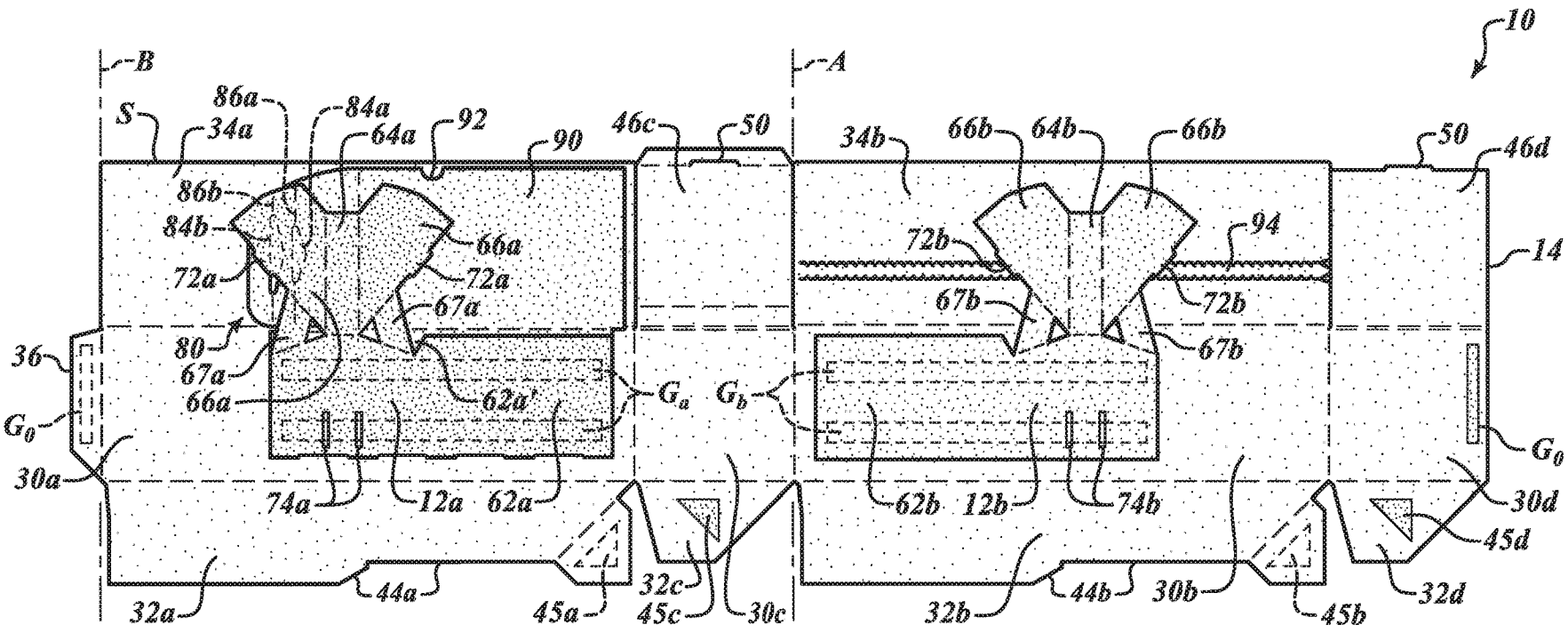
FIG. 1 is a plan view of a container structure, according to one example embodiment, in a splayed configuration showing a pair of support members coupled to interior surfaces of an outer case member.
Figure 3:
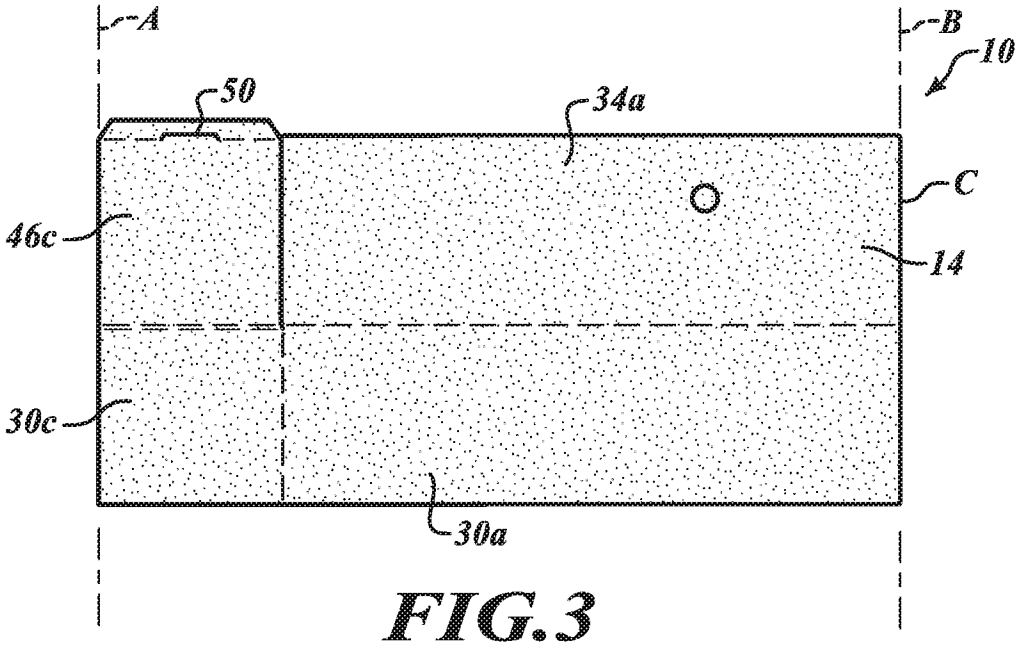
FIG. 3 is a plan view of the container structure of FIG. 1 in a sleeve configuration, which is shippable and erectable to form a container with an interior cavity for receiving and transporting items, such as, for example, flowers.
Figure 2:
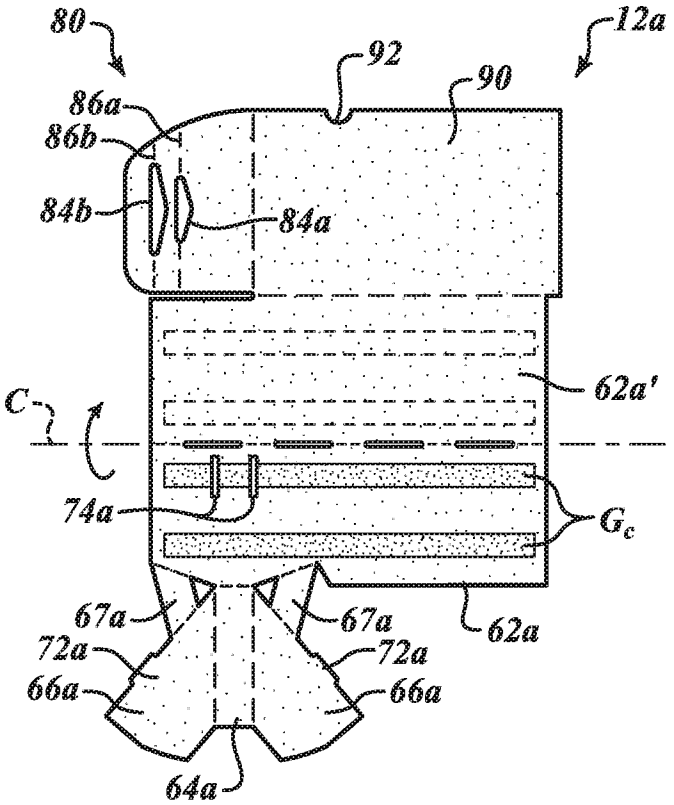
FIG. 2 is a plan view of one of the support members in a flat, pre-folded configuration.
Figure 4:
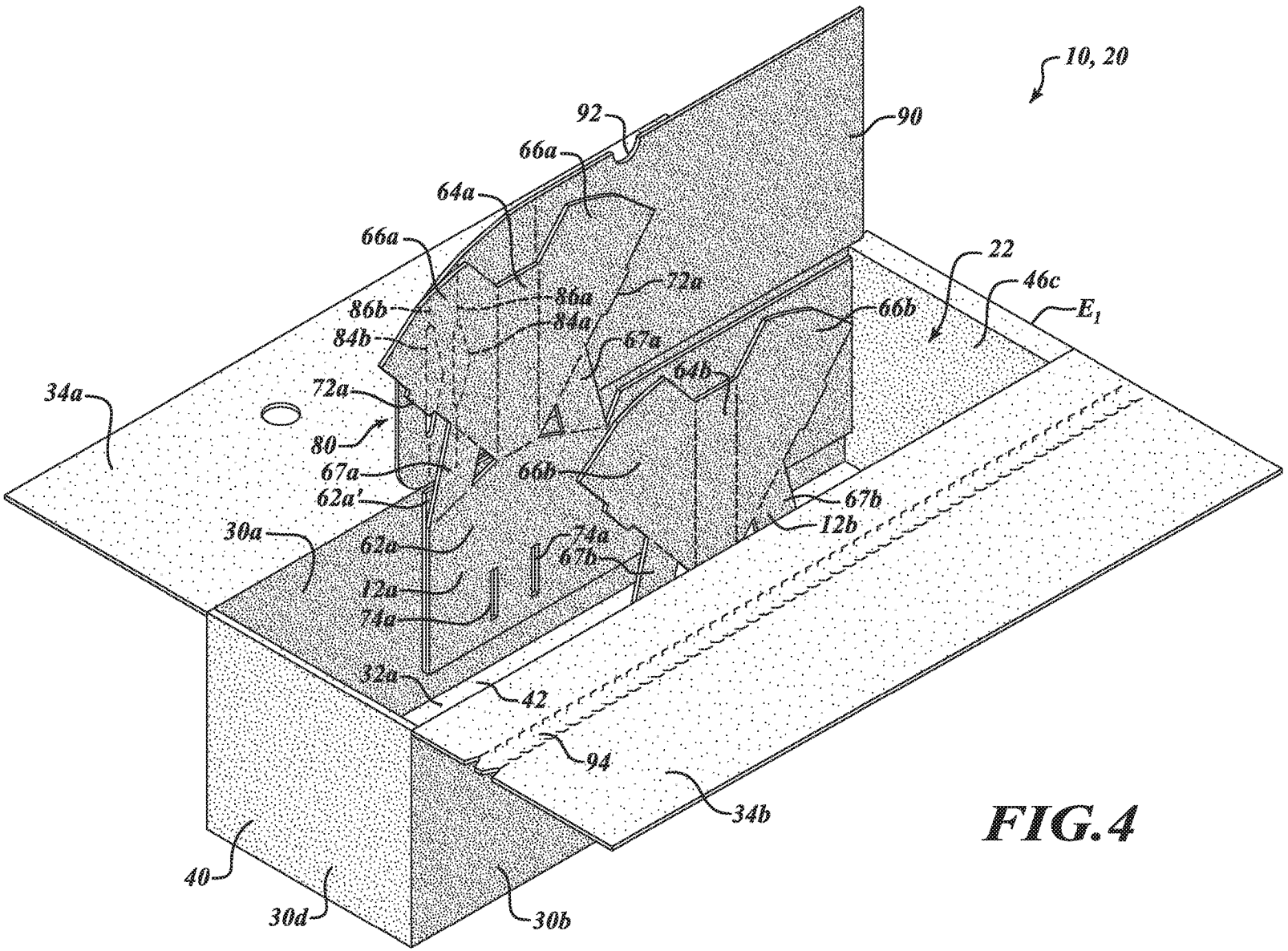
FIG. 4 is an isometric view of the container structure of FIG. 1 in a partially erected configuration in which the outer case member is erected to form an interior cavity for receiving and transporting items.
Figure 5:
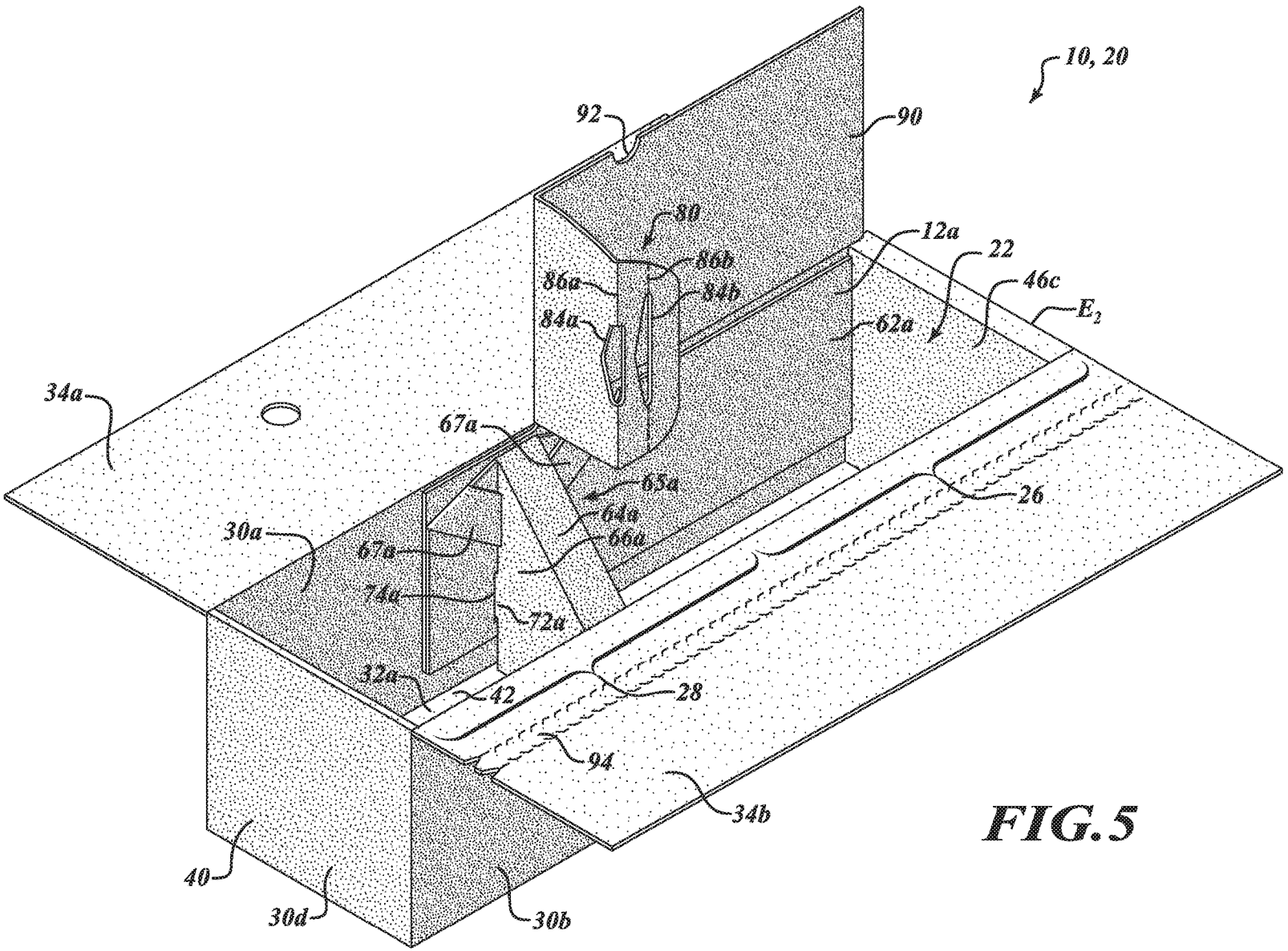
FIG. 5 is an isometric view of the container structure of FIG. 1 in an erected, ready-to-load configuration.
Figure 6:
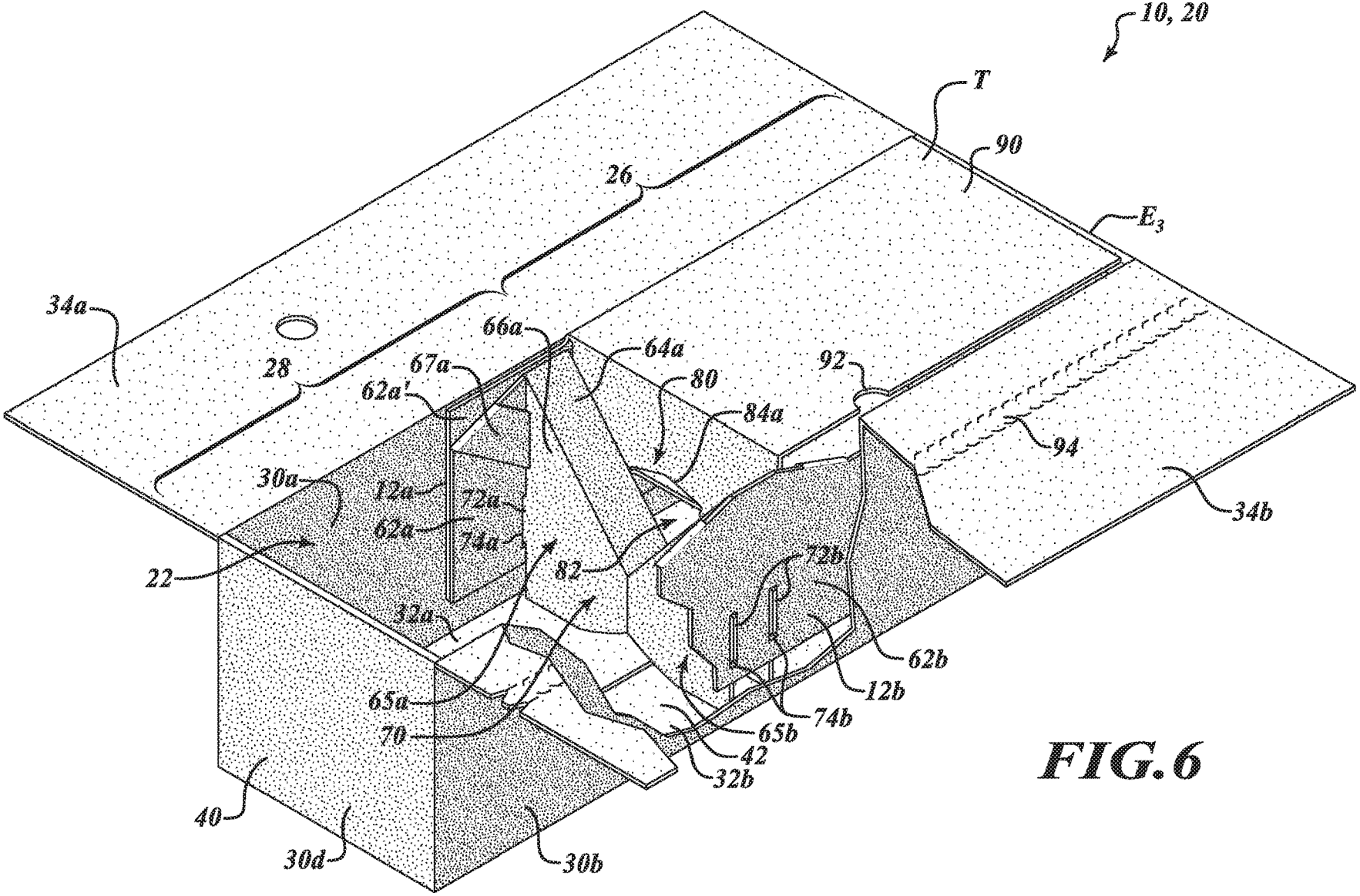
FIG. 6 is an isometric view of the container structure of FIG. 1 in an erected, ready-to-transport configuration with a portion of the container broken away to reveal additional details thereof.

FIGS. 1 through 6 show an example embodiment of a container structure 10 for transporting items, such as, for example, flowers, in a particularly secure and well-supported manner. FIG. 1 shows the container structure 10 in a splayed configuration S with a pair of support members 12*a*, 12*b* attached to interior surfaces of an outer case member 14. FIG. 2 shows one of the support members 12*a* in a flat, pre-folded configuration. FIG. 3 shows the container structure 10 in a sleeve or collapsed configuration C, which is erectable to form a container 20 (FIGS. 4, 5 and 6) having an interior cavity 22 for receiving and transporting flowers or other items. FIG. 4 shows the container in a partially erected configuration $E_1$ in which the outer case member 14 is erected to form the interior cavity 22 for receiving and transporting items. Finally, FIG. 5 shows the container structure 10 in an erected, ready-to-load configuration $E_2$, while FIG. 6 shows the container structure 10 in an erected, ready-to-transport configuration $E_3$.

With reference to FIG. 1, the outer case member 14 of the container structure 10 includes a plurality of sidewall panels 30*a*-30*d*, a plurality of floor or base panels 32*a*-32*d*, a plurality of top or closure panels 34*a*, 34*b* and an end flange 36, which are foldably connected to each other to erect to form a generally rectangular outer case 40, as shown in FIGS. 4, 5 and 6, within which to receive and transport items. More particularly, the outer case member 14 is erectable from the sleeve or collapsed configuration C shown in FIG. 3, in which the container structure 10 is substantially flat, to the erected configuration shown in FIGS. 4, 5 and 6, in which the plurality of sidewall panels 30*a*-30*d* and the plurality of base panels 32*a*-32*d* collectively define the interior cavity 22 for receiving and transporting flowers or other items.

The base panels 32*a*-32*d* of the outer case member 14 may overlap in a conventional manner when folded to collectively form a floor or base 42 of the erected container 20, as shown in FIG. 6. With reference again to FIG. 1, the base panels 32*a*-32*d* may include interlocking features 44*a*, 44*b*, which collectively lock the base 42 and outer case 40 in the erected configuration shown in FIGS. 4, 5 and 6, without the use of adhesives or other fastening devices. In order to lock the base 42 and outer case 40 in the erected configuration, the base panels 32*a*-32*d* may be folded in an overlapping manner and moved past a horizontal position until the interlocking features 44*a*, 44*b* of the base panels 32*a*, 32*b* initially interlock. After the interlocking features 44*a*, 44*b* of the base panels 32*a*, 32*b* initially interlock, the base panels 32*a*-32*d* may relax back toward a horizontal position until the interlocking features 44*a*, 44*b* of the base panels 32*a*, 32*b* bottom out and hold the base panels 32*a*-32*d* in a generally horizontal configuration. In some embodiments, including the illustrated embodiment of FIGS. 1 through 6, base panel 32*a* and base panel 32*c* may be fixedly coupled together with adhesive, and base panel 32*b* and base panel 32*d* may be fixedly coupled together with adhesive, to assist in forming the floor or base 42 of the erected container 20, such as, for example at the locations labeled 45*a*-45*d*.

With continued reference to FIG. 1, the outer case member 14 of the container structure 10 may further include a plurality of end panels 46*c*, 46*d* foldably coupled to respective sidewall panels 30*c*, 30*d*, which are configured to fold inwardly toward the base panels 32*a*, 32*b* after erection of the outer case member 14. Upon folding, the end panels 46*c*, 46*d* may engage locking apertures provided in the base panels 32*a*-32*d* which are exposed to the interior cavity 22 of the erected container 20, or otherwise interact with the base panels 32*a*-32*d*, to assist in locking the outer case member 14 in the configuration of the erected container 20. For this purpose, each of the end panels 46*c*, 46*d* may be provided with a locking tab 50 or other feature for engaging such locking apertures or for otherwise interacting with the base panels 32*a*-32*d*. When locked in this manner, the end panels 46*c*, 46*d* and the respective sidewall panels 30*c*, 30*d* to which they are foldably coupled may form a dual-walled structure at opposing ends of the erected container 20. The panels 30*c*, 30*d*, 46*c*, 46*d* of this dual-walled structure may be flush or offset from each other. When locked in the manner described above, the container structure 10 is held securely in the erected configuration shown in FIGS. 4, 5 and 6.

With reference to FIG. 1, the pair of support members 12*a*, 12*b* are coupled to interior surfaces of an outer case member 14. Each support member 12*a*, 12*b* includes a base panel 62*a*, 62*b* that is fixedly coupled (either directly, or indirectly) to a respective one of the plurality of sidewall panels 30*a*, 30*b* of the outer case member 14, such as, for example, by adhesive $G_a$, $G_b$ or other fastening devices. In the case of the example embodiment shown in FIGS. 1 through 6, the support member 12*a* may include a first base panel 62*a* and a second base panel 62*a*' foldably coupled to the first base panel 62*a* and being fixedly attached to the first base panel 62*a* in a face-to-face relationship, such as, for example, by adhesive $G_c$, to form a folded, dual-layer structure, as can be achieved by folding a blank of the support member 12*a* about fold line C in FIG. 2 to form the structure shown in FIG. 1 that is attached to the outer case member 14. Accordingly, in the splayed configuration S shown in FIG. 1, as well as the sleeve or collapsed configuration C shown in FIG. 2, the support members 12*a*, 12*b* may lay substantially flat against the outer case member 14. In some instances, the support members 12*a*, 12*b* may span across a respective interface between the sidewall panels 30*a*, 30*b* and the closure panels 34*a*, 34*b* of the outer case member 14, as shown in FIG. 1.

Each of the support members 12*a*, 12*b* may include a portion that is manipulable (e.g., erectable, foldable) to form a support structure for supporting the item during transport. For example, as shown in FIGS. 1 and 4 through 6, each support member 12*a*, 12*b* may include a support panel 64*a*, 64*b* foldably coupled to and extending from the base panel 62*a*, 62*b*, and a respective pair of wing panels 66*a*, 66*b*, foldably coupled to and extending from the support panel 64*a*, 64*b*, which can be erected into adjacent trough structures 65*a*, 65*b*, as shown in FIG. 6. The adjacent trough structures 65*a*, 65*b* may collectively form a V-shaped trough 70 for receiving and supporting a portion of the item to be transported in the container 20. To assist in transitioning the support panels 64*a*, 64*b* and opposing wing panels 66*a*, 66*b* into the adjacent trough structures 65*a*, 65*b*, each support member 12*a*, 12*b* may further include bridging panels 67*a*, 67*b* that span between the opposing wing panels 66*a*, 66*b* and the base panel 62*a*, 62*b*. As can be appreciated from FIGS. 4 through 6, the support panel 64*a*, 64*b* and opposing wing panels 66*a*, 66*b* of each support member 12*a*, 12*b* can be folded from the flat state shown in FIG. 4, wherein the support panel 64*a*, 64*b* and opposing wing panels 66*a*, 66*b* of each support member 12*a*, 12*b* protrude from the erected outer case 40, to the adjacent trough structures 65*a*, 65*b* shown in FIG. 6 to collectively form the V-shaped trough 70. The trough 70 of the example embodiment is suitable to support a portion of the item or items to be transported, such as, for example, the stems of an arrangement of flowers.

Each of the opposing wing panels 66*a*, 66*b* may include one or more lock devices 72*a*, 72*b* to secure a portion of the support members 12*a*, 12*b* in a support configuration when the outer case member 14 is in the erected configuration. The lock device 72*a*, 72*b* may be a locking tab, for example, and may engage a corresponding locking aperture 74*a*, 72*b* provided in the base panel 62*a*, 62*b* of the support member 12*a*, 12*b*. In this locked configuration, the support members 12*a*, 12*b* may be securely held in the support configuration shown in FIGS. 5 and 6.

After the container structure 10 is formed into the sleeve or collapsed configuration C shown in FIG. 3 and subsequently erected into the erected configuration $E_1$ shown in FIG. 4, the support members 12*a*, 12*b* may be manipulated (e.g., erected, folded) as described above to collectively form the V-shaped trough 70 of the erected configurations $E_2$, $E_3$ shown in FIGS. 5 and 6. In some instances, the V-shaped trough 70 may collectively partition the interior cavity 22 of the outer case member 14 into opposing regions or end portions 26, 28. For example, the adjacent trough structures 65*a*, 65*b* of the support members 12*a*, 12*b* may partition the interior cavity 22 into a first end portion 26 and a second end portion 28. The first end portion 26 may be configured to receive a receptacle or vessel, such as a vase, within which the item or items to be transported may be provided. The item or items to be transported may extend from the receptacle or vessel when disposed in the first end portion 26 into the second end portion 28 with an intermediate portion of the item or items supported by the support structure (e.g., V-shaped trough 70) provided by the support members 12*a*, 12*b*.

The opposing wing panels 66*a*, 66*b* of each support member 12*a*, 12*b* may be generally parallel to the sidewall panel 30*a*, 30*b* to which the support member 12*a*, 12*b* is attached when the outer case member 14 is in the collapsed configuration C shown in FIG. 3 or the erected configuration $E_1$ shown in FIG. 4. Conversely, when the container structure 10 is erected into the erected configurations $E_2$, $E_3$ shown in FIGS. 5 and 6, the opposing wing panels 66*a*, 66*b* of each support member 12*a*, 12*b* may be generally normal to the sidewall panel 30*a*, 30*b* to which the support member 12*a*, 12*b* is attached. In the final, locked support configuration, the support panels 64*a*, 64*b* may extend generally normal to the opposing wing panels 66*a*, 66*b* and inclined relative to the floor or base 42 to provide the V-shaped trough 70. Advantageously, the V-shaped trough 70 is configured to support a portion of an item or items to be transported offset from the floor or base 42 of the erected container 20. In some embodiments, for example, the trough 70 may be configured to support a portion of an item about midway between the floor or base 42 of the erected container 20 and the closure panels 34*a*, 34*b*.

With reference to FIGS. 1, 2 and 4 through 6, at least one of the support members 12*a*, 12*b*, may be provided with a wedge device 80 for selectively wedging the item or items to be transported into the V-shaped trough 70 defined by the support members 12*a*, 12*b* when the container structure 10 is in the erected ready-to-transport configuration $E_3$. For example, the wedge device 80 may be configured to cooperate with the support panels 64*a*, 64*b* of the support members 12*a*, 12*b* to define a window 82 when the container structure 10 is in the erected configuration $E_3$ as shown in FIG. 6. When viewing the window 82 in a direction normal to the end sidewall panels 30*c*, 30*d*, the window 82 may have a diamond shape, triangular shape or other shaped profile that may be well suited to receive and pack a plurality of like items (e.g., flower stems) in a secure manner. The shape of the window 82 may be defined by a projected profile of the V-shaped trough 70 and a portion of an aperture 84*a*, 84*b* of the wedge device 80.

The wedge device 80 may be adjustable to adjust a size of the window 82. For example, the wedge device 80 may include pre-formed creases, scores, perforations or other features 86*a*, 86*b* that facilitate folding the wedge device 80 into one of several possible wedge configurations. For example, the example embodiment of the container structure 10 of FIGS. 1 through 6 show the wedge device 80 with two pre-formed features 86*a*, 86*b* for selectively folding the wedge device 80 into two different wedge configurations. FIGS. 5 and 6 show the wedge device 80 bent about one of the pre-formed features 86*a* for selectively folding the wedge device 80 into one configuration that is adapted to define a window 82 that is relatively larger than if the wedge device 80 was folded about the other pre-formed feature 86*b*.

The wedge device 80 may be coupled to the second base panel 62*a*' of the support member 12*a* by an upper panel 90. The upper panel 90 may be configured to enable selective movement of the wedge device 80 into and out of engagement with the item or items to be transported by rotating the upper panel 90 relative to the second base panel 62*a*'. The upper panel 90 may be sized and shaped to substantially cover the first end portion 26 of the interior cavity 22 of the erected container 20 after moving the wedge device 80 into engagement with the item or items to be transported. In this manner, the upper panel 90, the adjacent trough structures 65*a*, 65*b* of the support members 12*a*, 12*b* and the outer case member 14 may form a sub-compartment that substantially encloses the first end portion 26 of the interior cavity 22 irrespective of the position of the closure panels 34*a*, 34*b* of the outer case member 14. Accordingly, a receptacle or vessel, such as a vase, may be enclosed within the first portion 26 of the interior cavity 22 of the erected container 20 prior to folding the closure panels 34*a*, 34*b*. A cutout 92, tab or other feature may be provided to facilitate moving the upper panel 90 and hence wedge device 80 away from the transport configuration T, as shown in FIG. 6, to reveal the receptacle or vessel and item or items stored therein, as shown in FIG. 5.

Figure 7:
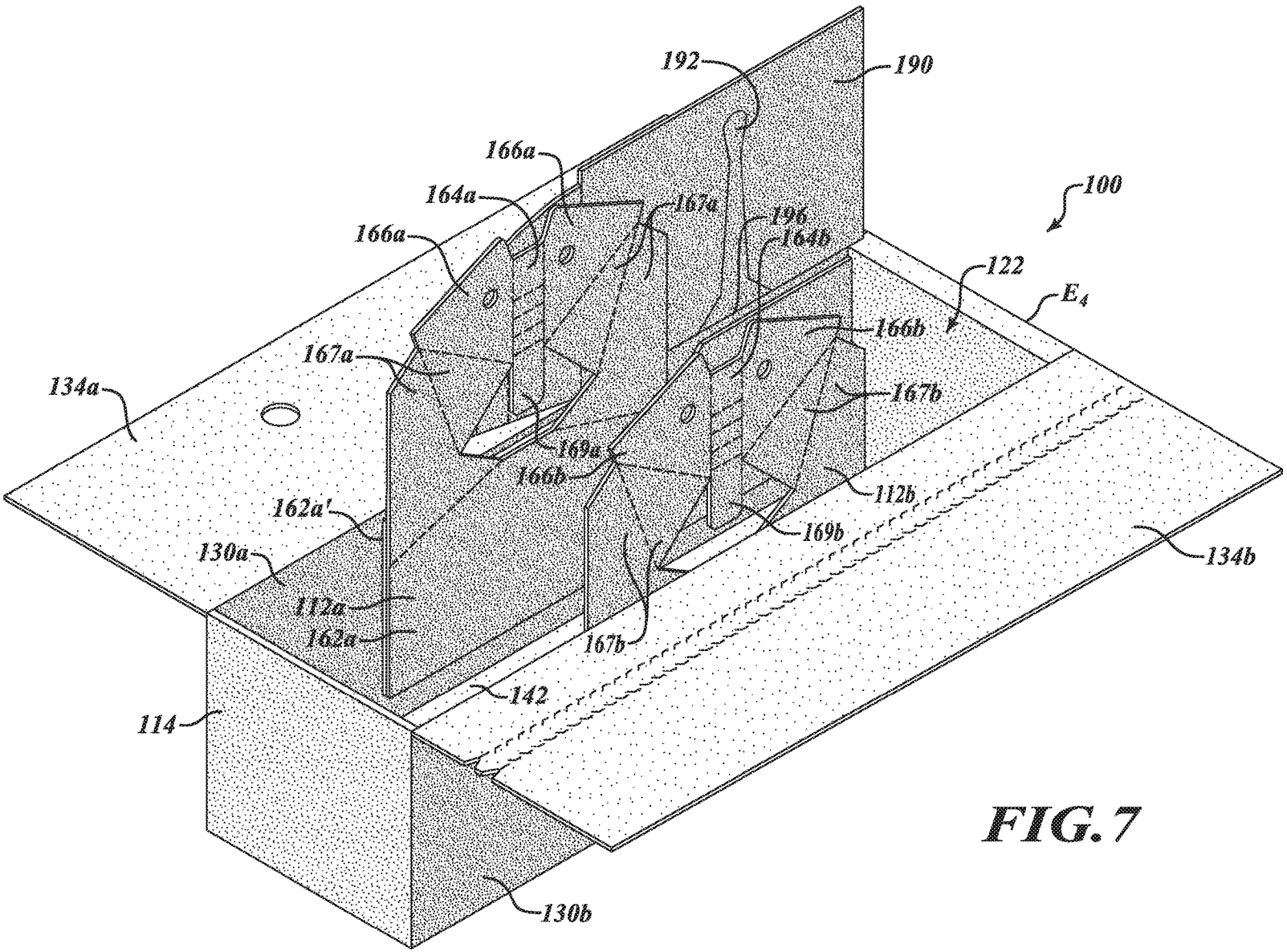
FIG. 7 is an isometric view of a container structure, according to another example embodiment, in a partially erected configuration in which an outer case member thereof is erected to form an interior cavity for receiving and transporting items, such as flowers. A pair of support members are shown coupled to interior surfaces of the outer case member.
Figure 8:
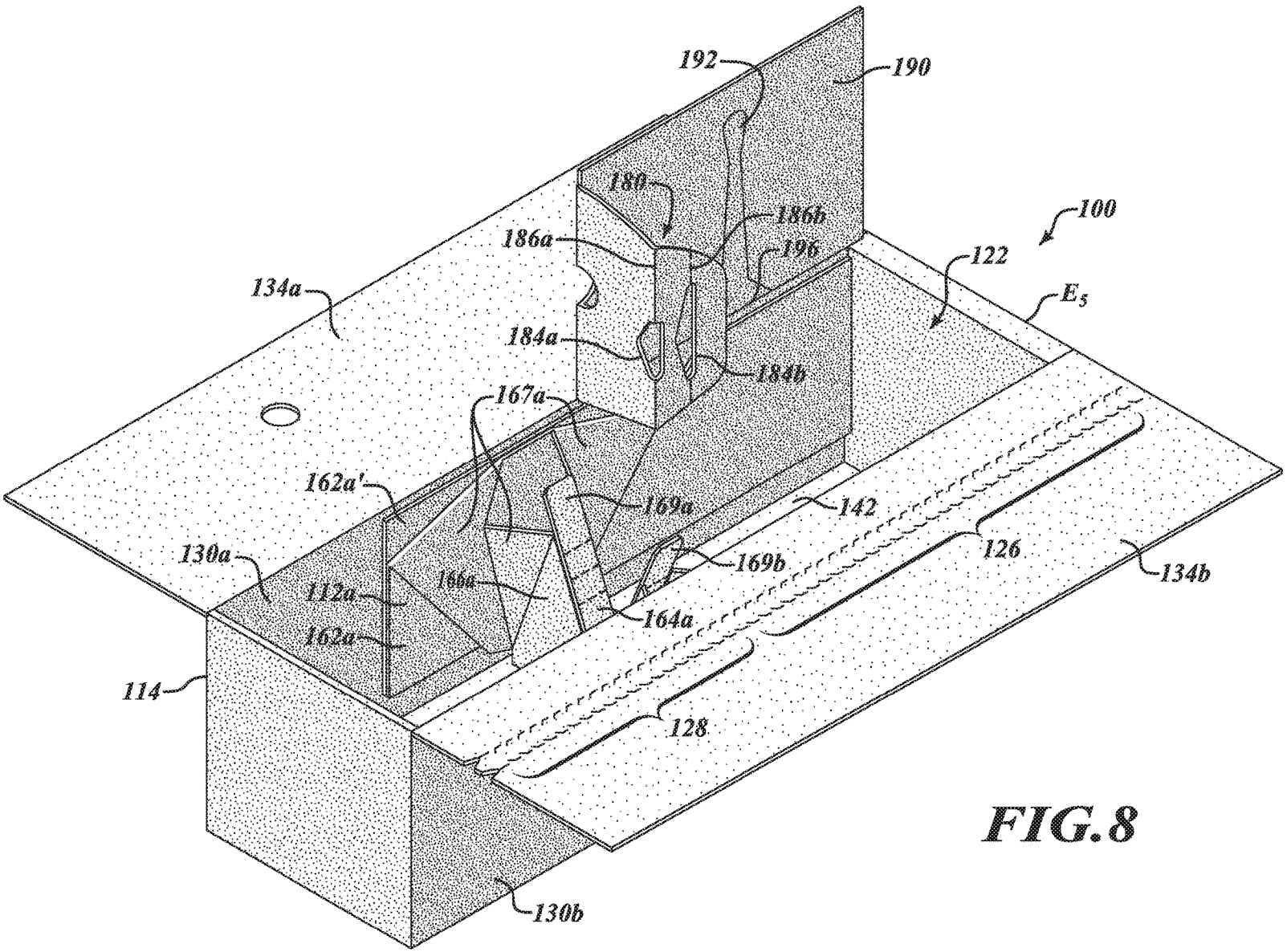
FIG. 8 is an isometric view of the container structure of FIG. 7 in an erected, ready-to-load configuration.
Figure 9:
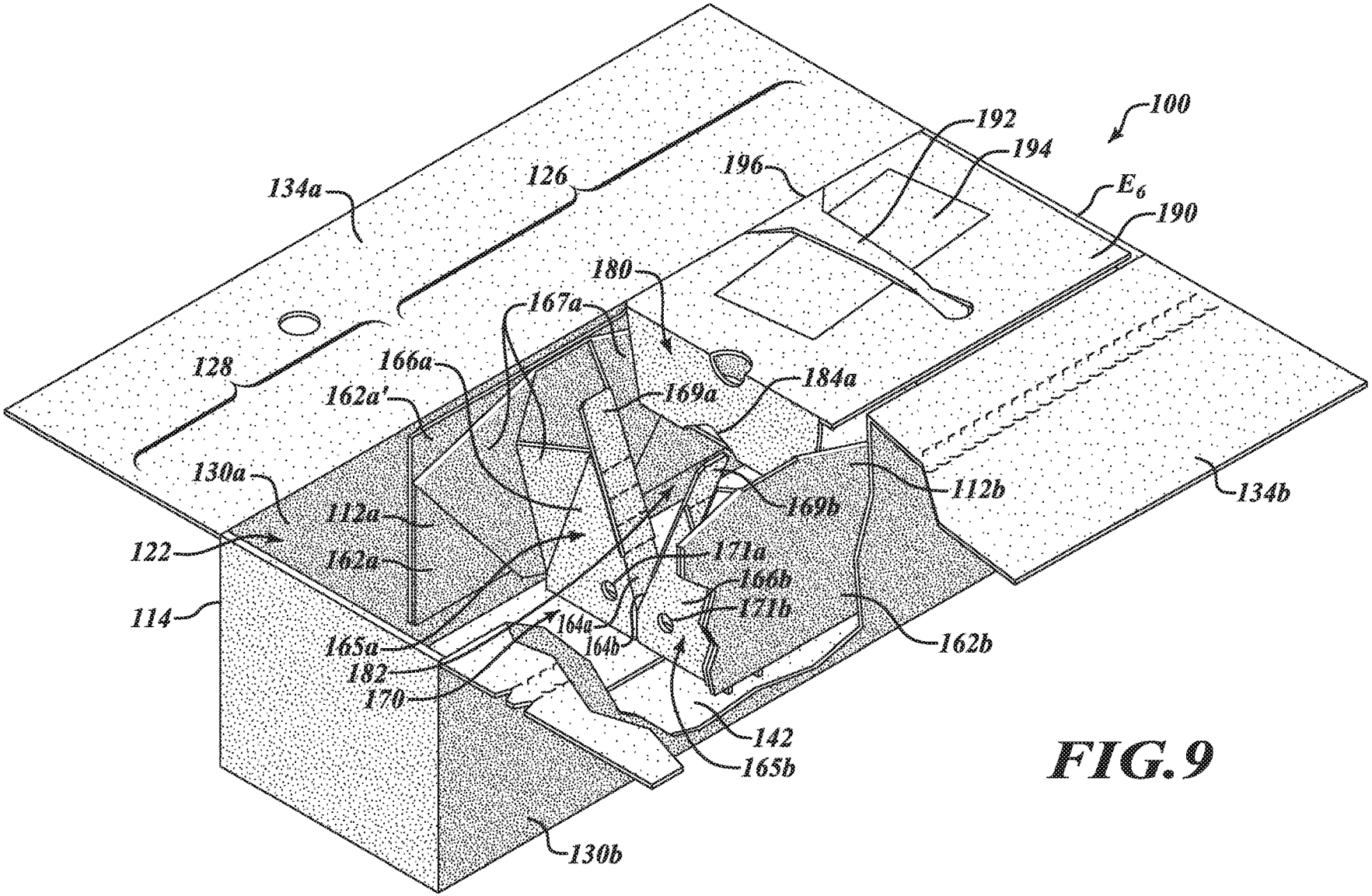
FIG. 9 is an isometric view of the container structure of FIG. 7 in an erected, ready-to-transport configuration with a portion of the container broken away to reveal additional details thereof.

FIGS. 7 through 9 show another example embodiment of a container structure 100 for transporting items, such as, for example, flowers, in a particularly secure and well-supported manner. FIG. 7 shows the container structure 100 in a partially erected configuration $E_4$ in which an outer case member 114 is erected to form an interior cavity 122 for receiving and transporting items such as flowers. FIG. 8 shows the container structure 100 in an erected, ready-to-load configuration $E_5$, while FIG. 9 shows the container structure 100 in an erected, ready-to-transport configuration $E_6$.

With reference to FIG. 7, a pair of support members 112*a*, 112*b* are coupled to interior surfaces of the outer case member 114. Each support member 112*a*, 112*b* includes a base panel 162*a*, 162*b* that is fixedly coupled (either directly, or indirectly) to a respective one of a plurality of sidewall panels 130*a*, 130*b* of the outer case member 114, such as, for example, by adhesive or other fastening devices. In the case of the example embodiment shown in FIGS. 7 through 9, the support member 112*a* may include a first base panel 162*a* and a second base panel 162*a*' foldably coupled to the first base panel 162*a* and fixedly attached to the first base panel 162*a* in a face-to-face relationship, such as, for example, by adhesive, to form a folded, dual-layer structure, as can be achieved by folding a blank of the support member 112*a* about a single fold line prior to being attached to the outer case member 114.

Each of the support members 112*a*, 112*b* may include a portion that is manipulable (e.g., erectable, foldable) to form a support structure for supporting the item during transport. For example, as shown in FIGS. 7 through 9, each support member 112*a*, 112*b* may include a support panel 164*a*, 164*b* foldably coupled to and extending from the base panel 162*a*, 162*b*, and a respective pair of wing panels 166*a*, 166*b*, foldably coupled to and extending from the support panel 164*a*, 164*b*, which can be erected into adjacent trough structures 165*a*, 165*b*, as shown in FIG. 9. The adjacent trough structures 165*a*, 165*b* may collectively form a V-shaped trough 170 for receiving and supporting a portion of the item to be transported in the container 100. To assist in transitioning the support panels 164*a*, 164*b* and opposing wing panels 166*a*, 166*b* into the adjacent trough structures 165*a*, 165*b*, each support member 112*a*, 112*b* may further include bridging panels 167*a*, 167*b* that span between the opposing wing panels 166*a*, 166*b* and the base panel 162*a*, 162*b*. As can be appreciated from FIGS. 7 through 9, the support panel 164*a*, 164*b* and opposing wing panels 166*a*, 166*b* of each support member 112*a*, 112*b* can be folded from a flat state shown in FIG. 7, wherein the support panel 164*a*, 164*b* and opposing wing panels 166*a*, 166*b* of each support member 112*a*, 112*b* protrude from the erected outer case member 114, to the adjacent trough structures 165*a*, 165*b* shown in FIG. 9 to collectively form the V-shaped trough 170. The trough 170 of the example embodiment is suitable to support a portion of the item or items to be transported, such as, for example, the stems of an arrangement of flowers.

In accordance with the example embodiment shown in FIGS. 7 through 9, the adjacent trough structures 165*a*, 165*b* may be configured to engage each other to lock the trough 170 in the erected configuration shown in FIGS. 8 and 9. In some instances, the V-shaped trough 170 may collectively partition the interior cavity 122 of the outer case member 114 into opposing regions or end portions. For example, the adjacent trough structures 165*a*, 165*b* of the support members 112*a*, 112*b* may partition the interior cavity 122 into a first end portion 126 and a second end portion 128. The first end portion 126 may be configured to receive a receptacle or vessel, such as a vase, within which the item or items to be transported may be provided. The item or items to be transported may extend from the receptacle or vessel when disposed in the first end portion 126 into the second end portion 128 with an intermediate portion of the item or items supported by the support structure (e.g., V-shaped trough 170) provided by the support members 112*a*, 112*b*.

The opposing wing panels 166*a*, 166*b* of each support member 112*a*, 112*b* may be generally normal to the sidewall panel 130*a*, 130*b* to which the support member 112*a*, 112*b* is attached when the container structure 100 is erected into the erected configurations $E_5$, $E_6$ shown in FIGS. 8 and 9. In the final, support configuration, the support panels 164*a*, 164*b* may extend generally normal to the opposing wing panels 166*a*, 166*b* and may be inclined relative to the floor or base 142 to provide the V-shaped trough 170. Advantageously, the V-shaped trough 170 is configured to support a portion of an item or items to be transported offset from the floor or base 142 of the erected container 100. In some embodiments, for example, the trough 170 may be configured to support a portion of an item between about one-quarter to about halfway between the floor or base 142 of the erected container 100 and closure panels 134*a*, 134*b* of the outer case member 114.

Each support member 112*a*, 112*b* may further include a respective hold down member 169*a*, 169*b* formed integrally with the support panel 164*a*, 164*b*. The hold down members 169*a*, 169*b* may be folded about a plurality of bend lines to surround a portion of the item or items to be transported to assist in securing such item(s) with the trough 170. The hold down members 169*a*, 169*b* may be provided with pressure sensitive adhesive or other adhering structure to enable a user to secure the hold down members 169*a*, 169*b* together in a state in which they are wrapped around a portion of the item or items to be transported. In this manner, conventional tie downs for securing the contents within the container 100 may be avoided altogether. Alternatively, or in addition to the hold down members 169*a*, 169*b*, the opposing wing panels 166*a*, 166*b* may be provided with one or more apertures 171*a*, 171*b* to receive ties or the like for securing the item or items to be transported with the trough 170.

With continued reference to FIGS. 7 through 9, at least one of the support members 112*a*, 112*b*, may be provided with a wedge device 180 for selectively wedging the item or items to be transported into the V-shaped trough 170 defined by the support members 112*a*, 112*b* when the container structure 100 is in the erected ready-to-transport configuration $E_6$. For example, the wedge device 180 may be configured to cooperate with the support panels 164*a*, 164*b* of the support members 112*a*, 112*b* to define a window 182 when the container structure 100 is in the erected configuration $E_6$ as shown in FIG. 9. When viewing the window 182 in a direction normal to the end the container structure 100, the window 182 may have a diamond shape, triangular shape or other shaped profile that may be well suited to receive and pack a plurality of like items (e.g., flower stems) in a secure manner. The shape of the window 182 may be defined by a projected profile of the V-shaped trough 170 and a portion of an aperture 184*a*, 184*b* of the wedge device 180.

The wedge device 180 may be adjustable to adjust a size of the window 182. For example, the wedge device 180 may include pre-formed creases, scores, perforations or other features 186*a*, 186*b* that facilitate folding the wedge device 180 into one of several possible wedge configurations. For example, the example embodiment of the container structure 100 of FIGS. 6 through 9 show the wedge device 180 with two pre-formed features 186*a*, 186*b* for selectively folding the wedge device 180 into two different wedge configurations. FIGS. 8 and 9 show the wedge device 180 bent about one of the pre-formed features 186*a* for selectively folding the wedge device 180 into one configuration that is adapted to define a window 182 that is relatively larger than if the wedge device 180 was folded about the other pre-formed feature 186*b*.

The wedge device 180 may be coupled to the second base panel 162*a*' of the support member 112*a* by an upper panel 190. The upper panel 190 may be configured to enable selective movement of the wedge device 180 into and out of engagement with the item or items to be transported by rotating the upper panel 190 relative to the second base panel 162*a*'. The upper panel 190 may be sized and shaped to substantially cover the first end portion 126 of the interior cavity 122 of the erected container 100 after moving the wedge device 180 into engagement with the item or items to be transported. In this manner, the upper panel 190, the adjacent trough structures 165*a*, 165*b* of the support members 112*a*, 112*b* and the outer case member 114 may form a sub-compartment that substantially encloses the first end portion 126 of the interior cavity 122 irrespective of the position of the closure panels 134*a*, 134*b* of the outer case member 114. Accordingly, a receptacle or vessel, such as a vase, may be enclosed within the first portion 126 of the interior cavity 122 of the erected container 100 prior to folding the closure panels 134*a*, 134*b*.

With reference to FIG. 9, the upper panel 190 may include a hold down member 192 that is formed therein for receiving an envelope 194, a card, a receipt and/or other generally planar substrate associated with the item or items to be transported. For example, when transporting flowers, an envelope 194 may be held between the hold down member 192 and a remainder of the upper panel 190. The holder member 192 may be elongate and may be hingedly attached to the remainder of the support member 112*a* at a fold line 196 to enable the hold down member 192 to be displaced back and forth toward and away from the remainder of the upper panel 190.

In view of the above, and with reference to the example embodiment of FIGS. 1 through 6, it will be appreciated by those of ordinary skill in the relevant art that a method of packaging an item in a container 20 for transport may be provided which includes erecting an outer case member 14 from a collapsed configuration C to an erected configuration to define an interior cavity 22 to receive the item; configuring a first functional portion (e.g., support panel 64*a* and wing panels 66*a*) of a support member 12*a* that is fixedly attached to the outer case member 14 to form a structure (e.g., trough structure 65*a*) to at least one of partially support or partially secure the item to be transported within the outer case member 14; and configuring a second functional portion (e.g., wedge device 80 and upper panel 90) of the same support member 12*a* that is fixedly attached to the outer case member 14 to form another structure (e.g., wedge device 80) to at least one of partially support or partially secure the item to be transported within the outer case member 14.

As shown in the example embodiment of FIGS. 1 through 6, the first functional portion (e.g., support panel 64*a* and wing panels 66*a*) may be foldably coupled to and extend from the first base panel 62*a*, and the second functional portion (e.g., wedge device 80 and upper panel 90) may be foldably coupled to and extend from the second base panel 62*a*', which itself may be fixedly attached to the first base panel 62*a* in a face-to-face relationship to form a folded, dual-layer structure. The first and second functional portions may each extend from a side of the first and second base panels 62*a*, 62*a*' opposite the side where the first and second base panels 62*a*, 62*a*' are foldably coupled together. For example, the first and second functional portions may each extend from an upper side or edge of the first and second base panels 62*a*, 62*a*' that is opposite a lower side or edge where the first and second base panels 62*a*, 62*a*' are foldably coupled together.

The method may further include placing the item in the interior cavity 22 of the outer case member 14 to be supported at least in part by the first functional portion of the support member 12*a*, and sandwiching and/or entrapping the item between the first functional portion (e.g., support panel 64*a*) and the second functional portion (e.g., wedge device 80) of the support member 12*a*. Placing the item in the interior cavity 22 of the outer case member 14 may include positioning a vase of flowers in the interior cavity 22 of the outer case member 14 with at least one stem of the flowers in contact with the support members 12*a*, 12*b*. The support members 12*a*, 12*b* may be locked in a trough arrangement 70 to support a portion of the item or items offset from a floor or base 42 of the outer case member 14.

The method may further include, after placing the item in the interior cavity 22, positioning a wedge device 80 relative to adjacent trough structures 65*a*, 65*b* of the support members 12*a*, 12*b* to establish a window 82 through which the item extends and wedging the item between the wedge device 80 and the trough structures 65*a*, 65*b* of the support members 12*a*, 12*b*. The method may conclude with sealing the outer case member 14 in a closed configuration, such as, for example, by positioning closure panels 34*a*, 34*b* over the interior cavity 22 and securing the closure panels 34*a*, 34*b* in the closed configuration with adhesive, tape or other devices. Advantageously, sealing the outer case member 14 in the closed configuration may maintain the wedge device 80 in position relative to the trough structures 65*a*, 65*b* of the support members 12*a*, 12*b* to secure the item therebetween while the item is transported.

With reference to FIGS. 1 through 3, the collapsed configuration C of the outer case member 14 may be formed by cutting a blank of corrugated paperboard material to include a plurality of sidewall panels 30*a*-30*d*, a plurality of base panels 32*a*-32*d*, and a plurality of closure panels 34*a*, 34*b*, which are foldably connected to each other to form a generally rectangular outer case 40; attaching the support members 12*a*, 12*b* to the blank of the outer case member 14 while in a substantially flat configuration; and then folding the outer case member about fold lines A, B; and securing end flange 36 to sidewall panel 30*d* with adhesive $G_0$ or other fastening devices, such as, for example, staples or tape.

To attach the support members 12*a*, 12*b* to the blank of the outer case member 14, one base panel 62*a*', 62*b* of each support member 12*a*, 12*b* may be fixedly coupled to a respective one of the plurality of sidewall panels 30*a*, 30*b* of the outer case member 14, such as, for example, with adhesive $G_a$, $G_b$ or other fastening devices. In this position, the upper panel 90 of one of the support members 12*a* may overlie a portion of the closure panel 34*a* that is foldably coupled to the sidewall panel 30*a* to which the support member 12*a* is attached. In a similar manner, the support panel 64*a*, 64*b* and wing panels 66*a*, 66*b* of each support member 12*a*, 12*b* may overlie a portion of the closure panel 34*a*, 34*b* that is foldably coupled to the sidewall panel 30*a*, 30*b* to which the support member 12*a*, 12*b* is attached. The support members 12*a*, 12*b* may be attached to the outer case member 14 with the support members 12*a*, 12*b* entirely within the outer profile of the folded outer case member 14, as shown in FIG. 3.

The support members 12*a*, 12*b* may each be formed from a blank of corrugated paperboard material having the same thickness or a different thickness from that of the blank of the outer case member 14. The maximum thickness of the container structure 10 in the splayed configuration S shown in FIG. 1 may therefore be equal to the thickness of the blank of the outer case member 14 and twice the thickness of the blank of a support member 12*a*, whereas the maximum thickness of the container structure 10 in the sleeve or collapsed configuration C shown in FIG. 3 may be equal to twice the thickness of the outer case member 14 and the collective thickness of twice the thickness of the blank of the support member 12*a* and the thickness of the blank of the support member 12*b*. Due to the generally flat and relatively thin nature of the container structures 10 in the sleeve or collapsed configuration C shown in FIG. 3, a plurality of the container structures 10 can be conveniently stacked in the sleeve or collapsed configuration C for storage or shipment in bulk to remote locations, such as, for example, floral shops for subsequent erection and use in packaging and shipping delicate items, such as flowers, to customers.

As one of ordinary skill in the relevant art will appreciate, a recipient of a container 20 according to embodiments described herein will benefit from features of the same. For example, the recipient may quickly gain access to the items within the container 20 by removing a tear strip 94, opening the closure panels 34*a*, 34*b* and lifting the upper panel 90 via the cutout 92 without requiring tools, such as scissors or a knife. Still further, the container 20 can be quickly broken down to the sleeve or collapsed configuration C shown in FIG. 3 for recycling purposes.

Although the example embodiment of the container structure 10 shown in FIGS. 1 through 6 and the example embodiment of the container structure 100 shown in FIGS. 7 through 9 each erect to form a generally elongated, rectangular container 20, 100 that is partitioned about midway along a length thereof by adjacent trough structures 65*a*, 65*b*, 165*a*, 165*b*, it is appreciated that in other embodiments, an erected container may be provided having a different shape and may include one or more support structures at other positions along a length thereof. Additionally, although the support members 12*a*, 12*b*, 112*a*, 112*b* of the illustrated embodiments of FIGS. 1 through 6 and FIGS. 7 through 9 erect to form a V-shaped trough 70, 170 with a closable lid (e.g., upper panel 90, 190) and wedge device 80, 180, it is appreciated that in other instances the support members 12*a*, 12*b*, 112*a*, 112*b* may erect to create one or more support structures having other forms to at least one of support or secure the item or items within the container 20, 100.

Moreover, aspects and features of the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A container for transporting an item, the container comprising:

an outer case member having a plurality of sidewall panels and a plurality of base panels, the outer case member erectable from a collapsed configuration, in which the container is substantially flat, to an erected configuration, in which the plurality of sidewall panels and the plurality of base panels collectively define an interior cavity to receive the item to be transported; and a pair of support members, each support member being separate and distinct from the other and from the outer case member, and being fixedly coupled to a respective one of the plurality of the sidewall panels of the outer case member, and each support member being at least partially erectable to project from a respective side of the outer case member to at least one of partially support or partially secure the item to be transported within the interior cavity of the outer case member, and wherein at least one of the support members comprises:

a first base panel;

a second base panel foldably coupled to the first base panel and being fixedly attached to the first base panel in a face-to-face relationship to form a folded, dual-layer structure;

a first functional portion foldably coupled to the first base panel and being foldable to form a structure to at least one of partially support or partially secure the item to be transported within the outer case member; and a second functional portion foldably coupled to the second base panel and being foldable to form another structure to at least one of partially support or partially secure the item to be transported within the outer case member.

2. The container of claim 1 wherein the structure formed by the first functional portion is a part of a trough to partially support the item to be transported within the interior cavity of the outer case member.

3. The container of claim 1 wherein the another structure formed by the second functional portion comprises a cover movable between an open position and a closed position to conceal at least a portion of the item to be transported within the interior cavity of the outer case member when the cover is in the closed position.

4. The container of claim 1 wherein the another structure formed by the second functional portion comprises a wedge device that cooperates with the first functional portion to secure the item to be transported within the outer case member.

5. The container of claim 1 wherein the first functional portion and the second function portion are configured to sandwich a portion of the item between the first functional portion and the second function portion when the container is in a fully erected transport configuration.

6. The container of claim 1 wherein, when the container is in a fully erected transport configuration, the first functional portion contacts the item to be transported from a first side and the second functional portion contacts the item to be transported from a second side opposite the first side.

7. The container of claim 1 wherein the first functional portion and the second function portion are configured to entrap the item to be transported within the interior cavity of the outer case member when the container is in a fully erected transport configuration.

8. The container of claim 1 wherein the support members are at least partially erectable to form adjacent trough structures for supporting the item to be transported, each trough structure including a support panel between opposing wing panels.

9. The container of claim 8 wherein the wing panels of the trough structure of each support member are foldably coupled to and extend from the support panel and lock into a portion of the support member.

10. The container of claim 8 wherein the support members include hold down members integrally formed with and extending from the support panels, the hold down members being foldable about a plurality of preformed bend lines to collectively wrap around a portion of the item to be transported.

11. The container of claim 8 wherein the support members include hold down members integrally formed with and extending from the support panels, the hold down members including adhesive for securing the hold down members together in a state in which the hold down members collectively wrap around a portion of the item to be transported.

12. The container of claim 8 wherein the opposing wing panels of the trough structures include apertures extending therethrough to receive one or more ties for securing the item to be transported to the trough structures.

13. The container of claim 8 wherein the trough structures are configured to engage each other and lock the trough structures in an erected configuration.

14. A container for transporting an item, the container comprising:

an outer case member erectable from a collapsed configuration to an erected configuration; and at least one support member fixedly attached to the outer case member, the support member being at least partially erectable and comprising:

a first base panel;

a second base panel foldably coupled to the first base panel and being fixedly attached to the first base panel in a face-to-face relationship to form a folded, dual-layer structure;

a first functional portion foldably coupled to and extending from the first base panel and being manipulable to form a structure to at least one of partially support or partially secure the item to be transported within the outer case member; and a second functional portion foldably coupled to and extending from the second base panel and being manipulable to form another structure to at least one of partially support or partially secure the item to be transported within the outer case member.

15. The container of claim 14 wherein the structure formed by the first functional portion is a part of a trough to partially support the item to be transported within the outer case member.

16. The container of claim 14 wherein the another structure formed by the second functional portion comprises a cover movable between an open position and a closed position to conceal at least a portion of the item to be transported in the outer case member when the cover is in the closed position.

17. The container of claim 14 wherein the another structure formed by the second functional portion comprises a wedge device that cooperates with the first functional portion to secure the item to be transported in the outer case member.

18. The container of claim 14 wherein the first functional portion and the second function portion are configured to sandwich a portion of the item between the first functional portion and the second function portion when the container is in a fully erected transport configuration.

19. The container of claim 14 wherein, when the container is in a fully erected transport configuration, the first functional portion contacts the item to be transported from a first side and the second functional portion contacts the item to be transported from a second side opposite the first side.

20. The container of claim 14 wherein the first functional portion and the second function portion are configured to entrap the item to be transported within the outer case member when the container is in a fully erected transport configuration.

21. The container of claim 14 wherein the container comprises a pair of support members that are at least partially erectable to form adjacent trough structures for supporting the item to be transported, each trough structure including a support panel between opposing wing panels.

22. The container of claim 21 wherein the wing panels of the trough structure of each support member are foldably coupled to and extend from the support panel and lock into a portion of the support member.

23. The container of claim 21 wherein the support members include hold down members integrally formed with and extending from the support panels, the hold down members being foldable about a plurality of preformed bend lines to collectively wrap around a portion of the item to be transported.

24. The container of claim 21 wherein the support members include hold down members integrally formed with and extending from the support panels, the hold down members including adhesive for securing the hold down members together in a state in which the hold down members collectively wrap around a portion of the item to be transported.

25. The container of claim 21 wherein the opposing wing panels of the trough structures include apertures extending therethrough to receive one or more ties for securing the item to be transported to the trough structures.

26. The container of claim 21 wherein the trough structures are configured to engage each other and lock the trough structures in an erected configuration.

27. A method of packaging an item in a container for transport, the method comprising:

erecting an outer case member from a collapsed configuration to an erected configuration to define an interior cavity to receive the item;

configuring a first functional portion of a support member that is fixedly attached to the outer case member to form a structure to at least one of partially support or partially secure the item to be transported within the outer case member; and configuring a second functional portion of the same support member that is fixedly attached to the outer case member to form another structure to at least one of partially support or partially secure the item to be transported within the outer case member, wherein the support member includes a first base panel and a second base panel foldably coupled to the first base panel and being fixedly attached to the first base panel in a face-to-face relationship to form a folded, dual-layer structure, the first functional portion is foldably coupled to and extends from the first base panel, and the second functional portion is foldably coupled to and extends from the second base panel.

28. The method of claim 27, further comprising:

placing the item in the outer case member in the erected configuration to be supported at least in part by the first functional portion of the support member; and sandwiching the item between the first functional portion and the second functional portion of the support member.

29. The method of claim 27, further comprising:

placing the item in the outer case member in the erected configuration to be supported at least in part by the first functional portion of the support member; and entrapping the item between the first functional portion and the second functional portion of the support member.

30. The method of claim 27 wherein configuring the first functional portion includes configuring the first functional portion to form part of a trough to partially support the item to be transported within the outer case member.

31. The method of claim 27 wherein configuring the second functional portion includes configuring the second functional portion to form a cover movable between an open position and a closed position to conceal at least a portion of the item to be transported in the outer case member when the cover is in the closed position.

32. The method of claim 27 wherein configuring the second functional portion includes configuring the second functional portion to form a wedge device that cooperates with the first functional portion to secure the item to be transported in the outer case member.

33. A container for transporting an item, the container comprising:

an outer case member having a plurality of sidewall panels and a plurality of base panels, the outer case member erectable from a collapsed configuration, in which the container is substantially flat, to an erected configuration, in which the plurality of sidewall panels and the plurality of base panels collectively define an interior cavity to receive the item to be transported; and a pair of support members, each support member being separate and distinct from the other and from the outer case member, and being fixedly coupled to a respective one of the plurality of the sidewall panels of the outer case member, and each support member being at least partially erectable to project from a respective side of the outer case member to at least one of partially support or partially secure the item to be transported within the interior cavity of the outer case member, and wherein at least one of the support members comprises:

a first base panel;

a second base panel foldably coupled to the first base panel and being fixedly attached to the first base panel in a face-to-face relationship to form a folded, dual-layer structure;

a first portion including one or more panels foldably coupled to the first base panel and being foldable to form a support structure to at least one of partially support or partially secure the item to be transported within the outer case member; and a second portion including one or more panels foldably coupled to the second base panel and being foldable to form another support structure to at least one of partially support or partially secure the item to be transported within the outer case member.

* * * * *